United States Patent [19]

Malarchik

[11] Patent Number: 4,858,350

[45] Date of Patent: Aug. 22, 1989

[54] MEAL AND MARKET CALENDAR

[76] Inventor: Heidi M. Malarchik, 51 Birchwood Dr., Cranston, R.I. 02920

[21] Appl. No.: 237,810

[22] Filed: Aug. 29, 1988

[51] Int. Cl.[4] ..... G09D 3/04

[52] U.S. Cl. ..... 40/119; 40/122

[58] Field of Search ..... 40/107, 119, 122, 661, 40/110; 283/1 B, 2

[56] References Cited

U.S. PATENT DOCUMENTS 3,290,812 12/1966 Hunkins ..... 40/107

3,911,606 10/1975 Hunkins ..... 40/110

4,058,916 11/1977 Whyatt ..... 40/107

*Primary Examiner*—Robert P. Swiatek

*Assistant Examiner*—Cary E. Stone

*Attorney, Agent, or Firm*—Salter & Michaelson

[57] ABSTRACT

A means and market calendar comprising a plurality of transparent monthly calendar pages having indicia thereon defining squares for each day of the month, and a plurality of labels releaseably attachable to the square, the label having a meal menu printed on one side thereof, and the necessary main ingredients for the meal on the opposite side thereof.

7 Claims, 3 Drawing Sheets

MEAL AND MARKET CALENDAR

BACKGROUND AND SUMMARY OF THE INVENTION

The present invention relates to an organizational tool which facilitates the planning of meals in advance and which at the same time facilitates the shopping for the necessary ingredients of the pre-planned meals.

Meal planning and the shopping that is necessary therefor have longed proved to be a sometimes annoying and burdensome task for people who are preparing meals for themselves and/or their families. This is particularly true where the person responsible for planning the meals has a full or part-time job, as is often the case, thus limiting the time that is available for planning meals in advance and for organizing and doing the shopping that is necessary in connection therewith. Even where time is not the problem, the average meal planner is frequently at a loss as to what to prepare for meals, and furthermore, the average person is not usually educated as to what constitutes a balanced and nutritious diet. Although cookbooks may be used to give a meal planner new ideas for meal menus and at the same time provide information as to the ingredients necessary for making the meal, cookbooks per se do not provide a convenient means for planning a plurality of meals in advance. Quite to the contrary, a person armed with only a cookbook would really have no way of selecting a plurality of meal menus for use on a plurality of preselected future dates, and recording the information so that it would be always conveniently available.

The present invention overcomes this problem by providing a meal and market calendar that comprises a binder or book having a plurality of transparent pages, one for each month. Each page is in the nature of a monthly calendar, having indicia thereon defining a plurality of squares or blocks, there being, as in the usual monthly calendar page, five horizontal rows of seven squares or blocks each. Each square or block is provided with indicia indicating the numerical date of the day of the month, it being understood that since the page or sheet is transparent, the blocks and the date indicia thereon is visible from both the front and back side of the page. The present invention further comprises a plurality of labels that are adapted to be releaseably attached to each daily square or block, the labels being dimensioned so as to fit within each square or block, but at the same time configured and/or dimensioned so as not to cover the date indicia in said block. On one side of the label is a meal menu, while on the reverse side of said label there is a list of the main ingredients necessary to make the meal. Thus, any number of meal menus may be selected in advance and adhered to the calendar pages at the desired dates, it being understood that since the calendar pages are transparent, one simply has to look at the reverse side of the page to determine the ingredients that are necessary to make the meal that is on the opposite side of the label.

To further facilitate the necessary marketing for the meal ingredients, the book or binder of the present invention also includes a plurality of additional pages, each having a plurality of readily detachable envelopes thereon, each envelope having a shopping list printed thereon, whereby whenever the user goes shopping, he or she can check off the necessary ingredients on the shopping list, thereby facilitating the shopping experience. The envelope itself may be used to contain food coupons or the like which will be used while shopping.

It is therefore an object of the present invention to provide an organizational tool in the nature of a meal and market calendar that greatly facilitates meal planning.

Another object is a provision of a meal and market calendar that helps organize and facilitate the shopping that is necessary to purchase the ingredients that are necessary for a given meal.

A further object is the provision of a device of the character described that facilitates the planning of more balanced and nutritional meals.

Still another object is the provision of a device of the character described that is relatively simple and economically feasible to manufacture, and which is beneficial to users both from a health and economic standpoint.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
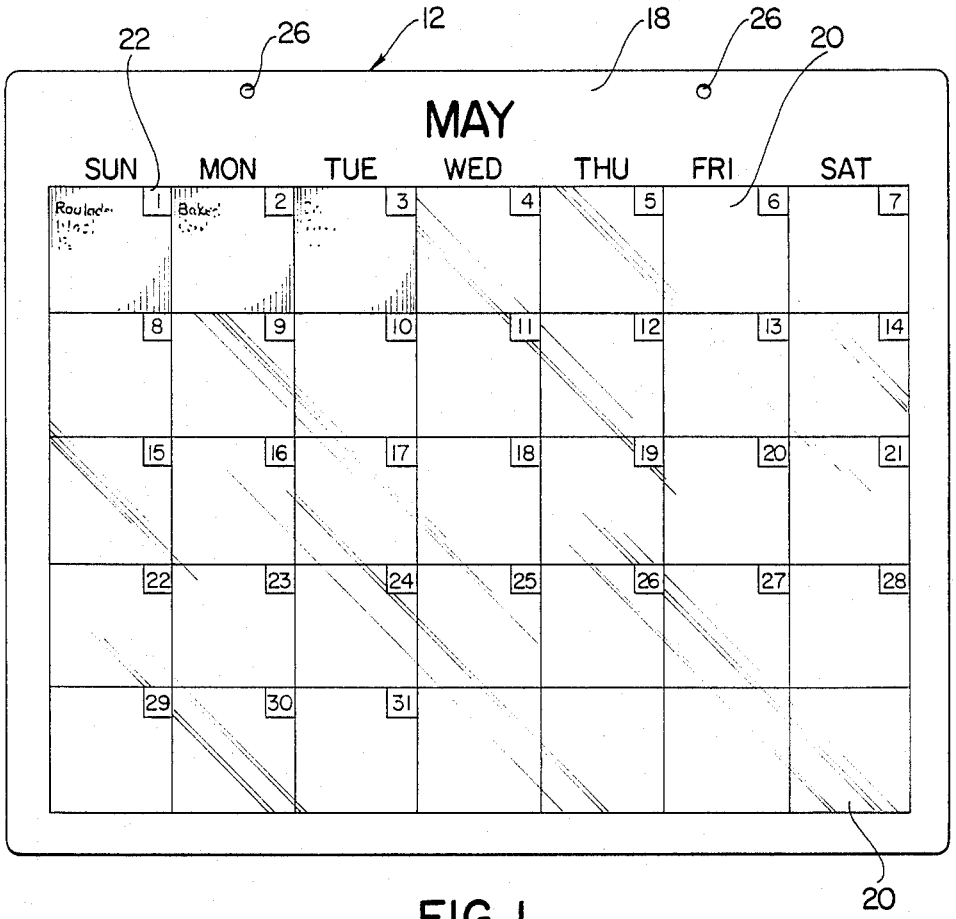
FIG. 1 is a front elevational view of one of the calendar pages that form a part of my meal and market calendar.
Figure 5:
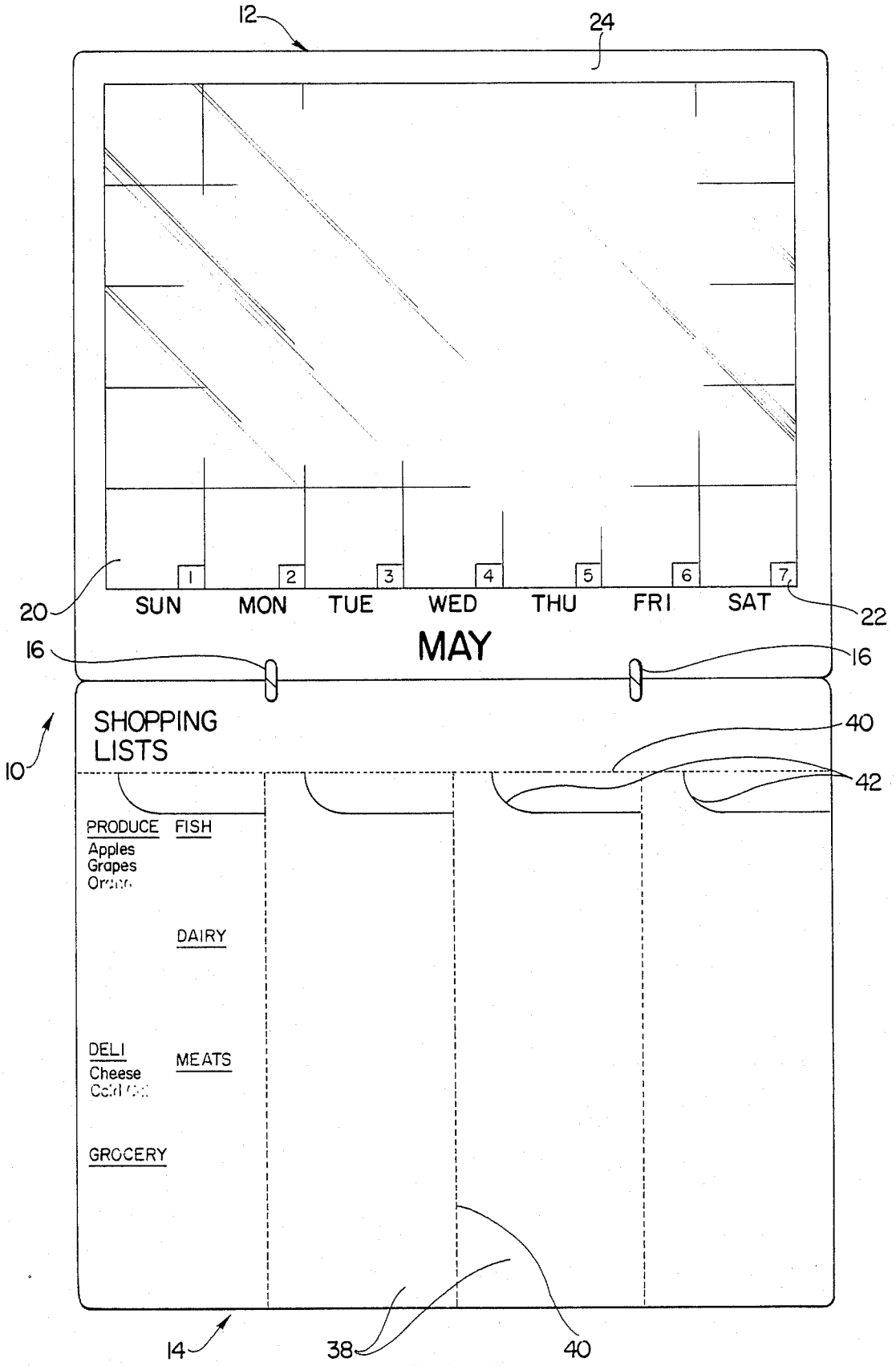
FIG. 5 is a front elevational view of a meal and market binder showing the rear side of a calendar sheet and a sheet comprising detachable envelopes having shopping lists printed thereon.

Referring now to the drawings, and more particularly to FIG. 5, there is shown generally at 10 at ring binder comprising a plurality of calendar pages shown generally at 12, and a plurality of pages 14 comprising shopping envelopes and shopping lists. The plurality of pages 12 and 14 are releaseably retained in the binder 10 by rings 16 although any other suitable means may be employed for retaining the pages 12 and 14 in book form. The calendar book or binder 10 preferably comprises twelve of the calendar pages 12, one for each month, and the pages 12 are each constructed of a substantially transparent plastic material, such as vinyl. As seen in FIG. 1, the front side 18 of each calendar sheet 12 has indicia thereon designating a month of the year and further indicia defining a plurality of daily squares or blocks 20. As will be noted, there are five horizontal rows of the squares 20, each row comprising seven squares, as is conventionally the case in a monthly calendar. Each vertical row of squares carries a day of the week identification at the top of each vertical row, all as is conventional in the normal monthly calendar. Each square 20 has applied thereto, preferably at the upper righthand corner, a small pressure sensitive tag 22 having thereon the numerical date. As shown most clearly in FIG. 5, when one views the rear surface 24 of the sheet 12, the squares 20 and the date tags 22 are readily visible, although the first day of the month now appears at the lower left hand corner rather than at the upper left hand corner as is the case when one views the front surface 18. The sheets 12 also comprise apertures 26 for receiving the rings 16.

It will be understood that the date tags 22 are easily removable from the pages 12 by peeling them off, whereupon the meal and market calendar 10 may be used in subsequent years by repositioning the date tags so that the tag with the number 1 thereon is located in the block that represents the first day of each month. If desired, however, the numerical date indicia could be printed on the pages 12, which would mean that each year the meal and market calendar 10 would become obsolete and would have to be replaced.

Figure 2:
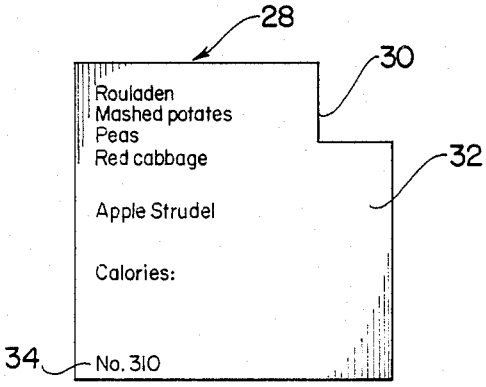
FIG. 2 is a front elevational view of the front side of one of the meal menu labels that form a part of my invention.
Figure 3:
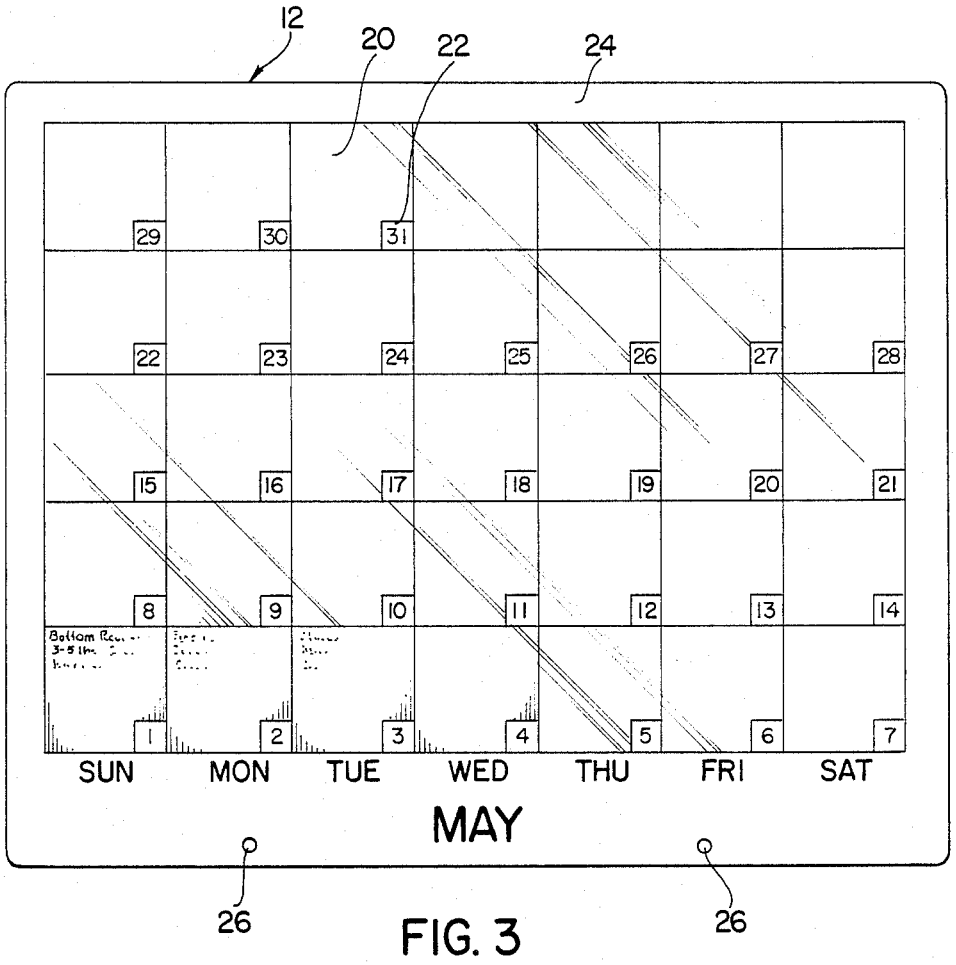
FIG. 3 is a rear view of the calendar sheet shown in FIG. 1.
Figure 4:
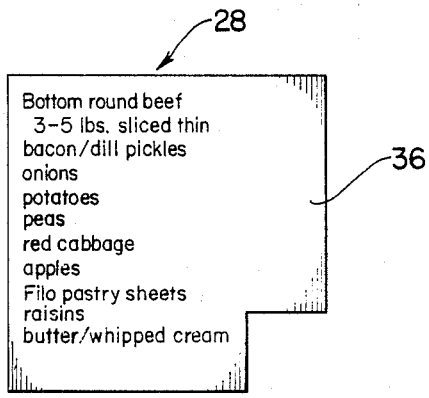
FIG. 4 is a rear view of the label shown in FIG. 2.

Referring now to FIGS. 2 and 4, there is shown a label 28 that is adapted to be releaseably attached to each square or block 20. As will be noted, the label 28 has a cut-out portion 30 at one of its corners so that when the label 28 is adhered to a block or square 20, the cut-out 30 will leave the date tag 22 visually exposed. It will be understood that the label 28 is dimensioned and configured so as to fit within each block or square 20, although the exact shape of the label 28 is unimportant, so long as the date tag 22 is not covered. On the front surface 32 of each label 28 there is printed thereon a meal menu, each meal menu preferably being identified by a number, as at 34. On the rear surface 36 of each label 28 (FIG. 4) there is provided a list of the ingredients necessary to make the meal menu that appears on the opposite side of the label. The labels 28 are attachable and removeable from the pages 12 by any conventional pressure sensitive adhesive means.

The sheet 14 shown in FIG. 5 comprises a plurality of envelopes 38 there being four such envelopes provided in the illustrated embodiment. Perforations 40 separate the envelopes from each other and from the page 14 whereupon whenever desired one of the envelopes may be torn away and used. Each envelope has an entry portion 42 adjacent its upper end whereby food coupons or the like may be retained in the envelope. In addition, each envelope has a complete shopping list printed thereon, whereby when the user of the meal and market calendar 10 is doing his or her shopping for the ingredients for one or more of the meal menus, the appropriate ingredients may be checked off on the list to facilitate and organize the shopping to be done. Preferably there is at least one of the pages 14 located between each pair of calendar pages 12 in the binder 10, although obviously more of the pages 14 may be provided if found necessary or desireable.

The labels 28 may be provided in any desireable form, i.e. they may be adhered to sheets or pages that could actually form a part of the book or binder 10, or the sheets or pages having the labels 28 adhered thereto may be separately provided. It will be understood, however, that a supply of the labels 28 forms a part of the meal and market calendar, whether provided in a separate packet, adhered to sheets etc. It is contemplated that a substantial number of the labels 28 will be provided for use with a book or binder 10, it being understood that meal menus may be provided for special diets, as well as for people who are not required to adhere to special diets. Although several hundred meal menu labels 28 will normally be provided with the meal and market calendar 10, it is contemplated that additional meal menu labels may be purchased when an additional supply of such labels becomes necessary for any reason.

In operation and use, a person may use the meal and market calendar 10 to plan as many advance meals as may be desired, up to a year. The appropriate labels 28 are adhered to whatever date it is desired to serve the particular meal menu that is on that label, and all one has to do is to flip the page 12 upwardly, as illustrated in FIG. 5, so that the rear surface 24 thereof becomes visible and the ingredients necessary for making the meal for any given date likewise become readily visible. Thus, not only may meals be planned in advance, but also the binder 10 makes it easy to do the necessary shopping in advance, and if certain ingredients are purchased in advance, they made by identified by marking the packaging for same with the menu number 34 that appears on the front side of each label 28. In this way if certain ingredients are stored in one's refrigerator in advance of the date on which they are to be used, the menu to which they are to be applied may be easily identified. As previously indicated, in order to facilitate and better organize the shopping that has to be done, one of the envelopes 38 may be detached from one of the pages 14 and the ingredients to be purchased may be noted on the checklist which appears on each envelope. At the same time, food coupons or the like may be positioned within the envelope for convenient carrying and access.

It will therefore be seen that the present invention provides a convenient organizational tool that enables a person to preplan daily menus and record same in a convenient and simple manner. Since the menus would be prepared by persons competent in dietary planning, the meals will be both balanced and nutritional, and where necessary, special menus are provided to meet special dietary requirements. In addition, the present invention not only facilitates meal planning, but also facilitates the shopping necessary for making the meals.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A meal and market calendar comprising a plurality of transparent calendar pages each having indicia thereon defining a plurality of discrete spaces, one for each day of the month, each page and the spaces thereon being viewable from the front and the back, each space having date indicia on the front and back side thereof, a plurality of labels adapted to be releaseably adhered to one side of said pages, each label fitting within one of said spaces without obliterating the date indicia for said space, each said label having a meal menu printed on one side thereof and the necessary main ingredients for said meal menu printed on the other side thereof, whereby daily meals and the marketing requirements therefor may be planned in advance by adhering selected labels to selected date spaces, the selected meal menu for any given date then being visible by looking at one side of the page, and the necessary ingredients for said selected meal menu being visible by looking at the opposite side of said page.

2. The meal and market calendar of claim 1 further characterized in that said date indicia is removeably attached to each page.

3. The meal and marketing calendar of claim 1 further characterized in that there is a separate page for each month.

4. The meal and marketing calendar of claim 3 further characterized in that said pages are attached together to form a book.

5. The book of claim 4, further comprising a plurality of additional pages each having a plurality of readily detachable envelopes, each envelope having a shopping list thereon, whereby the necessary ingredients for a given meal menu may be checked off, the envelope being usable to retain food coupons or the like.

6. In the book of claim 5, there being one of said additional pages located between each pair of calendar pages.

7. In the book of claim 5, the envelopes on each page being separated from each page and being separated from each other by perforations, whereby the envelopes may be torn away from the page whenever it is desired to use one.

* * * * *